US011225353B2

(12) United States Patent
Bauernfeind

(10) Patent No.: US 11,225,353 B2
(45) Date of Patent: Jan. 18, 2022

(54) PACKAGING SYSTEM COMPRISING A CARDBOARD STRUCTURE

(71) Applicant: ROBA SERVICES GMBH, Lützen (DE)

(72) Inventor: Roman Bauernfeind, Lipperswil (CH)

(73) Assignee: ROBA GROUP AG, Tägerwilen (CH)

( * ) Notice: Subject to any disclaimer, the term of this patent is extended or adjusted under 35 U.S.C. 154(b) by 658 days.

(21) Appl. No.: 14/869,026

(22) Filed: Sep. 29, 2015

(65) Prior Publication Data

US 2016/0016685 A1 Jan. 21, 2016

Related U.S. Application Data

(63) Continuation of application No. PCT/EP2014/000727, filed on Mar. 18, 2014.

(30) Foreign Application Priority Data

Apr. 12, 2013 (DE) ..... 10 2013 006 309.4

(51) Int. Cl.
*B65D 5/00* (2006.01)
*B65D 5/20* (2006.01)
(Continued)

(52) U.S. Cl.
CPC ..... *B65D 5/20* (2013.01); *B65B 61/20* (2013.01); *B65D 5/603* (2013.01); *B65D 25/02* (2013.01);
(Continued)

(58) Field of Classification Search
CPC ..... B31B 2105/00; B31B 2105/402; B31B 2120/406; B65D 5/56; B65D 5/603
(Continued)

(56) References Cited

U.S. PATENT DOCUMENTS 3,041,699 A 7/1962 Marshall et al.
3,104,012 A * 9/1963 Beamish ..... B65D 77/22 206/438
(Continued)

FOREIGN PATENT DOCUMENTS

DE 17 86 135 A1 11/1971
DE 28 37 127 A1 3/1979
(Continued)

OTHER PUBLICATIONS

International Search Report dated Jun. 6, 2014, dated Jun. 18, 2014.
(Continued)

*Primary Examiner* — Eyamindae C Jallow
(74) *Attorney, Agent, or Firm* — Norris McLaughlin, P.A.

(57) ABSTRACT

A packaging system comprising a trough and a packaging element separate therefrom for closing the trough, the packaging trough having an outer cardboard structure folded or formed from corrugated board with an insert of a single or multiple layer plastic film, the inner side of each side wall of the cardboard structure being connected by material means to the insert only in its upper part of the side wall, the insert forming a substantially identically shaped, but loose contact surface with the lower part of the inner side of each side wall down to the base of the packaging trough and the trough having at least one gas venting opening.

17 Claims, 1 Drawing Sheet

(51) Int. Cl.

| | |
|---|---|
| ***B65D 5/60*** | (2006.01) |
| ***B65D 85/76*** | (2006.01) |
| ***B65D 85/72*** | (2006.01) |
| ***B65B 61/20*** | (2006.01) |
| ***B65D 25/02*** | (2006.01) |
| *B31B 110/10* | (2017.01) |
| *B31B 105/00* | (2017.01) |
| *B31B 120/40* | (2017.01) |
| *B31B 50/81* | (2017.01) |

(52) U.S. Cl.
CPC ..... *B65D 85/72* (2013.01); *B65D 85/76* (2013.01); *B31B 50/81* (2017.08); *B31B 2105/00* (2017.08); *B31B 2105/0024* (2017.08); *B31B 2110/10* (2017.08); *B31B 2120/404* (2017.08)

(58) Field of Classification Search
USPC ..... 53/433
See application file for complete search history.

(56) References Cited

U.S. PATENT DOCUMENTS 3,515,331 A 6/1970 Guthrie, Sr.
3,785,544 A * 1/1974 Smith ..... B65D 25/34 206/446
3,792,809 A * 2/1974 Schneider ..... A47G 19/03 220/670
4,257,530 A * 3/1981 Faller ..... B29C 51/165 206/484
4,347,934 A * 9/1982 Goodman ..... B31C 1/06 206/525
4,555,381 A * 11/1985 Chazal ..... B29C 51/165 156/224
5,102,006 A 4/1992 Schellenberg
5,169,470 A * 12/1992 Goldberg ..... B29C 51/267 156/244.14
5,323,956 A * 6/1994 Marcontell ..... B65D 5/2033 229/109
5,326,021 A * 7/1994 Farrell ..... B65D 5/2033 229/109
5,356,070 A * 10/1994 Rigby ..... B29C 49/24 229/120.17
5,492,703 A * 2/1996 Gies ..... B65D 25/36 206/459.5
5,565,228 A * 10/1996 Gics ..... B65D 81/3453 206/564
5,679,109 A * 10/1997 Gics ..... B29C 66/81419 493/100
5,692,937 A * 12/1997 Zhang ..... A61L 15/58 442/149
6,536,189 B1 * 3/2003 Murray ..... B65B 25/001 53/440
6,651,874 B1 11/2003 Pedersen
9,415,887 B2 * 8/2016 Zwaga ..... B65D 77/2024
2005/0223650 A1 * 10/2005 Blake ..... A47K 13/14 52/3
2006/0065662 A1 * 3/2006 Goglio ..... B65D 5/243 220/573.1
2007/0062161 A1 * 3/2007 Dierl ..... B65B 9/20 53/412
2007/0161481 A1 * 7/2007 Graham ..... B65D 5/4608 493/93
2007/0262487 A1 * 11/2007 O'Hagan ..... B29C 45/14 264/241
2009/0090643 A1 * 4/2009 Fischer ..... B65D 75/322 206/361
2010/0193578 A1 * 8/2010 Sanders ..... B65D 65/403 229/120
2012/0071312 A1 * 3/2012 Seiche ..... B31F 1/0012 493/467
2012/0103856 A1 * 5/2012 Toft ..... B32B 3/266 206/524.2
2013/0062400 A1 * 3/2013 Meyer ..... B29C 51/162 229/120.02
2013/0327821 A1 * 12/2013 Zwaga ..... B65D 5/563 229/185.1

FOREIGN PATENT DOCUMENTS

DE 28 19 869 A1 11/1979
DE 31 17 736 A1 11/1982
DE 37 21 203 A1 1/1988
DE 19654230 A1 * 7/1998 ..... B65B 7/16
DE 699 23 461 T2 2/2006
FR 2 933 329 A1 1/2010
WO 2004/045985 A1 6/2004
WO 2007/103428 A2 9/2007
WO 2011/134590 A2 11/2011
WO 2011/134591 A2 11/2011

OTHER PUBLICATIONS

English Translation of International Search Report dated Jun. 6, 2014, dated Jun. 18, 2014.
German Office Action dated Apr. 12, 2013.
German Office Action dated Mar. 5, 2014.
German Office Action dated Aug. 27, 2014.

* cited by examiner

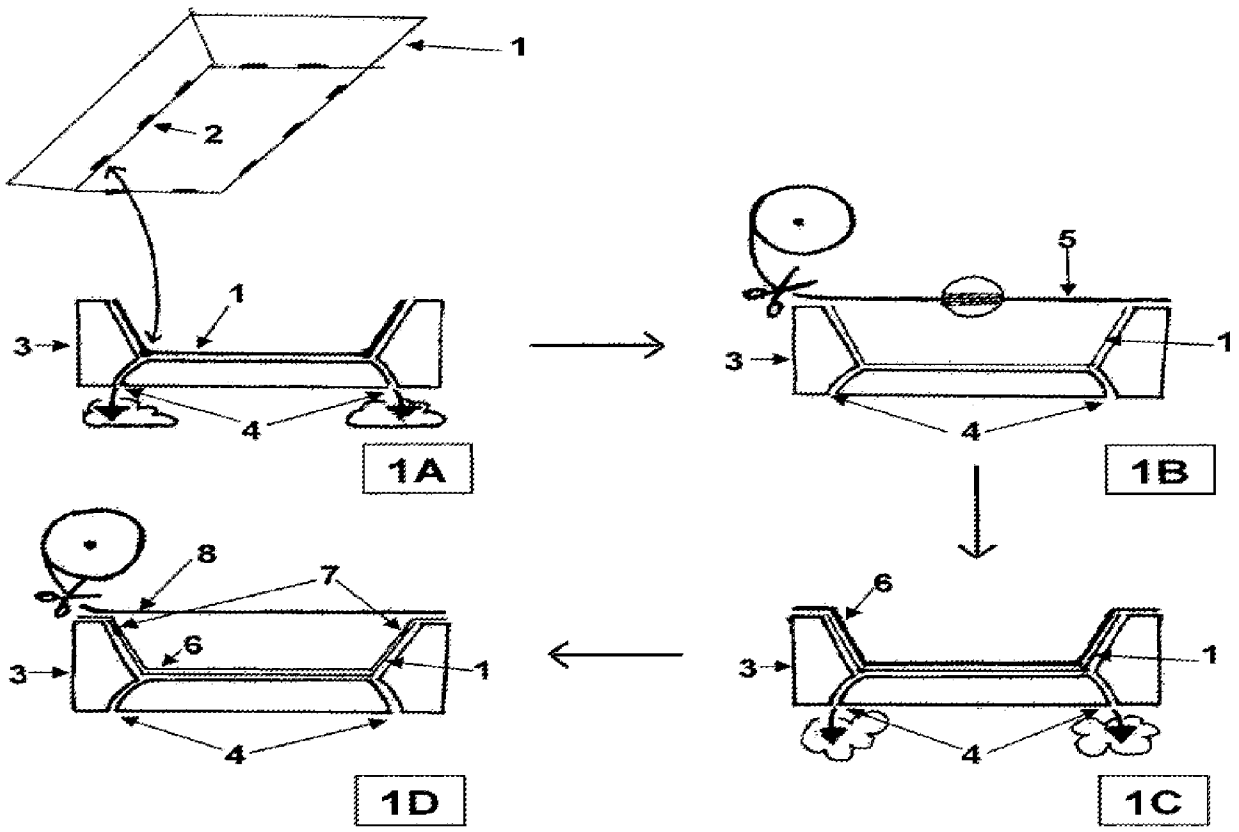
1
2
1A
1B
1C
1D
3
4
5
6
7
8

PACKAGING SYSTEM COMPRISING A CARDBOARD STRUCTURE

This application is a Continuation of International Patent Application No. PCT/EP2014/000727, filed on Mar. 18, 2014, which claims foreign priority benefits under 35 U.S.C. § 119 of German Patent Application No. 10 2013 006 309.4, filed Apr. 12, 2013, the disclosure of which patent application is incorporated herein by reference.

The present invention relates to a packaging system comprising a packaging tray and a packaging element, separate therefrom, for closing the tray, in which the packaging tray has an outer, folded or shaped cardboard structure of corrugated board with an insert of a single- or multi-layer plastics film, wherein the inner side of each side wall of the cardboard structure is connected to the insert by material bonding only in its upper portion, preferably no higher than the upper edge of the side wall, and the insert forms a substantially identically shaped but loose contact surface with the remaining lower region of the inner side of each side wall down to the bottom of the packaging tray and has at least in the bottom region at least one gas venting opening, preferably a plurality of gas venting openings arranged at regular intervals around the cardboard structure.

BACKGROUND OF THE INVENTION

The provision of packaging systems which are suitable especially for the packaging of foodstuffs, in particular fresh or cooked meat, poultry or fish, meat products such as ham or sausages, or non-food products represents a particular challenge. The packaging systems must not only provide hygienic protection for the product during transport and storage but also allow the products to be presented in a manner that is appealing to the customer so that, for example, the customer is able to have a close look at the product.

In order to maintain the product quality—such as freshness and color—as optimally as possible and to extend the shelf life, the products are packed in the packaging systems, which preferably consist of a tray and a lid, preferably under an inert gas atmosphere in order to keep the oxygen content in the packaging as low as possible.

The known packaging systems, in particular in the field of the foodstuffs industry, comprise inter alia a tray of plastics material, which is usually not produced from renewable raw materials. Further disadvantages may be high carbon dioxide emissions and high water consumption during production, as well as high costs for disposal. This is also true of packaging systems in which the packaging tray consists of cardboard that is laminated with a plastics film over its entire surface and the laminated surface of which faces the packaged product.

The object of the present invention was, therefore, to provide a packaging system which does not exhibit the disadvantages of the packaging systems of the prior art, that is to say in particular a packaging system which provides an improved insulating action for protecting the packaged product, or the consumer during handling.

The packaging system is accordingly to be based as far as possible only on renewable raw materials, which preferably are at least recyclable.

SUMMARY OF THE INVENTION

The object is achieved according to the invention by the provision of a packaging system comprising a packaging tray and a packaging element, separate from the packaged product, for closing the tray (the closing element), which packaging system is characterized in that the packaging tray has an outer, folded or shaped cardboard structure of corrugated board with an insert of a single- or multi-layer plastics film, wherein

BRIEF DESCRIPTION OF THE DRAWING

FIG. 1 illustrates a diagram of the process for producing the packaging system according to the invention.

DETAILED DESCRIPTION

The inner side of each side wall of the cardboard structure is connected to the insert by material bonding only in an upper portion, preferably not higher than the upper edge of the side wall, the insert forms a substantially identically shaped but loose contact surface with the remaining lower region of the inner side of each side wall down to and over the bottom of the packaging tray, and only the cardboard structure has at least in the bottom region at least one gas venting opening, preferably a plurality of gas venting openings arranged at regular intervals around the cardboard structure.

The packaging tray of the packaging system according to the invention is based on a cardboard structure made of corrugated board.

Corrugated board has high stability compared with solid board, despite its low intrinsic weight.

Furthermore, the insulating effect of packaging systems that are based substantially on corrugated board is improved owing to the air present within the corrugated structure, so that they have a comparatively high insulating effect with respect to cold and heat. The protection of the packaged product, in particular its freshness and shelf life, is thereby improved. In particular in the case of foodstuffs which are heated directly in the packaging by means of microwaves, the good insulating effect of the packaging systems according to the invention has an advantageous effect on handling, in that the consumer is protected from burning.

In addition, because the packaging systems according to the invention consist at least in part of a cardboard structure of corrugated board that is produced from renewable raw materials, fewer oil reserves are consumed. The plastics content of a packaging tray according to the invention can thus be reduced by up to 70% as compared with trays of conventional plastics material. In addition, the cardboard structure of corrugated board and the insert of the tray according to the invention can easily be separated from one another, which facilitates disposal. This is not possible where cardboard structures laminated with plastics films are used. Furthermore, the cardboard structure of corrugated board based on renewable raw materials can be recycled.

The packaging tray according to the invention has an outer, folded or shaped cardboard structure of corrugated board.

The opening of the tray-shaped corrugated board structure can be polygonal, preferably triangular, rectangular, square or round. The side walls of the cardboard structure of corrugated board can taper more or less conically towards the base in the conventional manner, as a result of which the packaging tray according to the invention can better be stacked. The shape of the insert corresponds substantially to that of the corrugated board structure and is preferably likewise tray-shaped.

The cardboard structure of corrugated board preferably has a height of from 1.5 cm to 10 cm, more preferably from 2 cm to 8 cm. The width and length of a rectangular cardboard structure can preferably be from 3 cm to 30 cm, more preferably from 10 cm to 20 cm. The volume of the cardboard structure is preferably from 20 to 1500 $cm^3$, more preferably from 100 to 1000 $cm^3$, particularly preferably from 500 to 800 $cm^3$.

In a particularly preferred embodiment, the cardboard structure of corrugated board is tray-shaped, wherein the surface area of the bottom is larger than the surface area of each individual side wall. According to this embodiment, the side walls preferably taper conically towards the bottom.

Particularly preferably, the cardboard structures are punched out of a sheet of corrugated board or a web of corrugated board by means of a punching tool.

According to the invention, the cardboard structure of corrugated board is preferably shaped by being turned up (folding) or by mechanical shaping, preferably by exposure to moisture and/or heat. Such techniques form part of the prior art and are known to the person skilled in the art, for example from WO 2011/134590 and WO 2011/134591.

Within the meaning of the present invention, therefore, "mechanical shaping" preferably denotes the shaping of a web of corrugated board or of a sheet of corrugated board by mechanical action, preferably by means of a shaping tool, after it has been heated and wetted. The expression "mechanical shaping" preferably includes shaping under pressure and shaping by bending.

If the corrugated board structure is produced by turning up (folding), it is preferably to have a height of at least 2 cm. If the cardboard structure should have a height of <2 cm, the cardboard structure is preferably produced by mechanical shaping. The cardboard structure can preferably be produced, as described in WO 2011/134590 and WO 2011/134591, by folding and optionally subsequent material bonding, for example by adhesively bonding of a corrugated board blank. After folding, the corrugated board structure can also be fixed in its folded structure by an interlocking and/or friction-based connection. The corrugated board structure is preferably produced from a flat corrugated board blank by folding the side walls upwards and adhesively bonding them together. The side walls are preferably not perpendicular to the bottom but are so disposed that the cross-section of the corrugated board structure tapers from top to bottom.

In a preferred embodiment, the cardboard structure of corrugated board is shaped by folding (turning up), wherein the structure is fixed preferably by the adhesive bonding of flaps, preferably by means of a dispersion adhesive. Suitable dispersion of adhesives for the adhesive bonding of flaps are known to the person skilled in the art.

In another preferred embodiment, the cardboard structure is produced by mechanically shaping the corrugated board under the exposure to moisture and/or heat.

According to the invention, the cardboard structure is made of corrugated board. Corrugated boards, or webs of corrugated board, are generally known to the person skilled in the art and comprise a plurality of webs, that is to say at least two outer webs, which are separated by a fluted web, corresponding to a single-flute corrugated board. A corrugated board can, however, also have multi-flute webs, wherein two fluted webs are each separated from one another by an intermediate web. Preferably, there can be up to three fluted webs each separated from one another by intermediate webs, so that such a triple-flute corrugated board consists of seven webs, namely of two outer webs, three fluted webs and two intermediate webs. The individual webs of the corrugated board are adhesively bonded to one another.

Corrugated board can be adapted to different uses. The properties of the corrugated board are determined substantially by the type of paper that is used and its grammage, by the type of flute and/or the number thereof.

Preference is given according to the invention to single-flute and double-flute corrugated boards, and particular preference is given to single-flute corrugated boards.

Each of the outer webs, the fluted web, or each of the fluted webs, and each intermediate web can be made of the same or different types of paper. According to the invention, they are preferably made of different types of paper.

There is preferably used according to the invention a corrugated board in which the paper webs preferably have a grammage of from 50 to 150 $g/m^2$, preferably from 65 to 130 $g/m^2$, more preferably from 75 to 125 $g/m^2$.

As is known, corrugated board is divided, according to the flute size, into corrugated board with a very fine flute (F and G) to coarse flute (A).

There is preferably used according to the invention a corrugated board with a very fine flute (F and G) or with a microflute (E) or combinations thereof, particularly preferably a corrugated board with a very fine flute (F and G).

The cardboard structure of the packaging tray according to the invention therefore preferably consists of a single-flute corrugated board, preferably with a flute of size G, F or E.

If the corrugated board comprises a plurality of fluted webs, that is to say, for example, has double-flutes or triple-flute corrugated board, the individual fluted webs can also have different flute profiles. The corrugated board structure of the packaging tray according to the invention preferably consists of a multi-flute corrugated board, wherein each web or fluted web can have the same or a different structure.

The corrugated board structure of the packaging tray according to the invention can also be printed, in order to impart any product and consumer information or to serve as a decoration. Printing can be applied to the outside of the corrugated board structure and/or to the side walls and/or to the bottom. A printed corrugated board is preferably used. The printability of the corrugated board structure does not present difficulties even in the case of complex printing, which is not always the case with trays made of plastics material.

The insert of the packaging tray according to the invention is preferably composed of a single- or multi-layer, preferably heat-sealable plastics film of thermoplastic polymers.

The insert is preferably produced from a multi-layer plastics film comprising the following layer sequence:

(a) a layer (a), facing the packaged product, which is preferably heat-sealable and is composed of at least one thermoplastic olefin homo- or co-polymer, cyclo-olefin copolymer or mixtures thereof,
(b) an adhesion promoter layer (b),
(c) optionally a layer (c) composed of at least one homo- and/or co-polyamide,
(d) at least one barrier layer (d),
(c) optionally a further layer (c) composed of at least one homo- and/or co-polyamide,
(b) a further adhesion promoter layer (b),
(f) optionally a layer (f) composed of at least one thermoplastic olefin homo- or co-polymer, a cyclo-olefin copolymer or mixtures thereof or of at least one homo- or co-polyamide or mixtures thereof, (b) optionally a further adhesion promoter layer (b), and (e) an outer layer (e), facing the cardboard structure of corrugated board, which is preferably heat-sealable and is composed of at least one thermoplastic olefin homo- or co-polymer, cyclo-olefin copolymer or mixtures thereof.

Preferably, in addition the multi-layer film with the layer sequence (a) to (e) described before, can further comprise a layer sequence comprising (f) optionally a further layer (f) composed of at least one thermoplastic olefin homo- or co-polymer, a cyclo-olefin copolymer or mixtures thereof or of at least one homo- or co-polyamide or mixtures thereof, (b) a further adhesion promoter layer (b), (c) optionally a further layer (c) composed of at least one homo- and/or co-polyamide, (d) at least one barrier layer (d), (c) optionally a further layer (c) composed of at least one homo- and/or co-polyamide, (b) optionally a further adhesion promoter layer (b), whereby this layer sequence with its optionally present layer (f) is directly adjacent to the optionally present layer (f) of the layer sequence (a) to (e) and the layer (e) remains as the outer layer.

According to the invention, the plastics film which is used as the insert is preferably orientated in the longitudinal and/or transverse direction in a orientation ratio of at least 1:1.5, preferably at least 1:2, particularly preferably from 1:2 to 1:4, because such a multi-layer plastics film has a particularly high puncture resistance.

Despite such a biaxial orientation, the biaxially oriented, multi-layer plastics film only has a shrinkage of not more than 5%, preferably of 3%, because it is fixed after being orientated.

The insert film preferably has a thickness of from 30 to 400 μm, more preferably from 50 to 350 μm, yet more preferably from 70 to 300 μm, most preferably from 80 to 250 μm and in particular from 90 to 220 μm or from 100 to 200 μm.

As already stated, the multi-layer plastics film used as the insert can preferably have more than 2, particularly preferably 5 or more, layers. A plastics film that has from 5 to 10 layers is also particularly preferred as the insert.

Preferably, the insert used according to the invention is not inflatable, does not consist of segments and is not composed of a plurality of plastics webs. Preferably, the insert consists of only one plastics web, which is preferably thermoformed by deep-drawing.

Particularly preferably, the insert is based on a multi-layer plastics film which is composed substantially of thermoplastic polymers.

The insert of the packaging tray according to the invention preferably consists of a multi-layer plastics film which comprises a transparent film composite having preferably at least one optionally multi-ply heat-sealable layer based on at least one thermoplastic polymer, of at least one transparent layer of a thermoplastic polymer having a specific functionality and optionally of necessary adhesion promoter layers of a thermoplastic polymer.

As a layer having a specific functionality, the transparent film composite, or the multi-layer plastics film, which is used as the insert for the packaging tray according to the invention can have at least one, preferably transparent barrier layer (c), preferably a barrier layer against gases, such as oxygen or water vapor, against the migration of low molecular weight components and/or against taste or odor impairment or against moisture, which layer is optionally bonded to the adjacent layers via an adhesion promoter layer.

Preferably, the plastics film used as the insert of the packaging tray according to the invention has an oxygen permeability according to DIN 53380-3 of less than 10.00 $cm^3/(m^2 \cdot d \cdot bar)$ at 23° C. and 50% relative humidity.

Preferably, the oxygen permeability of the insert is not more than 8 $cm^3/(m^2 \cdot d \cdot bar)$, preferably not more than 7 or 6 $cm^3/(m^2 \cdot d \cdot bar)$, more preferably not more than 5, 4 or 3 $cm^3/(m^2 \cdot d \cdot bar)$, yet more preferably not more than 2, 1 or 0.5 $cm^3/(m^2 \cdot d \cdot bar)$, most preferably not more than 0.4, 0.3 or 0.2 $cm^3/(m^2 \cdot d \cdot bar)$ and in particular not more than 0.1, 0.09 or 0.08 $cm^3/(m^2 \cdot d \cdot bar)$ (in each case at 23° C. and 50% relative humidity).

According to the invention, the values of the water vapor permeability of the plastics film used as the insert of the packaging tray according to the invention preferably correspond at most to the above-mentioned oxygen permeability values, wherein the water vapor permeability is determined according to DIN ISO 53 122.

A Any thermoplastic film, in particular known from the field of foodstuffs technology, having the layer sequences listed before, can be used as insert.

Particularly preferably a multi-layer plastics film which comprises at least the polymer layers (a) to (e) and optionally (f) can be used as insert. The polyolefin layers (a) and (e) each preferably form the outer layer of the insert. Particularly preferably, the two outer layers of the plastics film are heat-sealable.

The polyolefin layers (a), (e) and optionally (f) of the multi-layer film according to the invention are based, identical or different, on a thermoplastic polyolefin, olefin copolymer or mixture thereof.

Polyolefins and olefin copolymers within the meaning of the present invention are preferably selected from the group comprising polyethylenes (PE)—in particular polyethylenes of low density of from 0.86 to 0.93 $g/cm^3$ (LDPE), linear polyethylenes of low density of from 0.86 to 0.94 $g/cm^3$ (LLDPE), which comprise in addition to ethylene as comonomer one or more α-olefins having more than 3 carbon atoms, polyethylenes of high density of from 0.94 to 0.97 $g/cm^3$ (HDPE) or ethylene copolymers with an α-olefin having 4 or more carbon atoms (mPE), (polypropylenes (PP), polyisobutylenes (PI), polybutylene (PB), ethylene-acrylic acid copolymers (EAA), ethylene-methacrylic acid copolymers (EMAA), ethylene-vinyl acetate copolymers with preferably from 60 to 99 mol. % ethylene (EVA), ethylene-propylene copolymers with preferably from to 10 mol. % ethylene (EPCo) and copolymers based on olefins, the molecules of which are crosslinked via ionic bonds, and mixtures of in each case at least two of the mentioned types of polymer.

As already mentioned, the plastics film which can be used as the insert of the packaging tray according to the invention preferably has at least one barrier layer (d). Suitable polymers for providing the desired barrier effect, in particular a gas or aroma barrier, are known to the person skilled in the art.

Suitable polymers are ethylene-vinyl alcohol copolymers (EVOH), polyvinylidene chloride (PVDC) and vinylidene chloride copolymers, preferably having a proportion of vinylidene chloride of 80% or more, optionally also blended with other polymers, such as ethylene/vinyl acetate copolymers (EVA). If the plastics film comprises a plurality of barrier layers (d), the barrier layers (d) are preferably each based, identical or different, on ethylene-vinyl alcohol copolymers.

In order to protect the barrier layer (d), if necessary, against the influence of moisture, it can in each case be provided with an intermediate layer (c). Such intermediate layers (c) can also protect the barrier layer (d), if necessary, against damage during thermoforming.

The intermediate layers (c) are preferably each based, identical or different, on a polyamide, copolyamide or mixtures thereof. Polyamides (PA) and copolyamides (CoPA) within the meaning of the present invention are preferably aliphatic or (partially) aromatic. Aliphatic polyamides are preferred. The polyamides or copolyamides preferably have a melting point in the range of from 160 to 240° C., more preferably from 170 to 220° C. Preferably at least one polyamide or copolyamide is selected from the group comprising PA 4, PA 6, PA 7, PA 8, PA 9, PA 10, PA 11, PA 12, PA 4.2, PA 6.6, PA 6.8, PA 6.9, PA 6.10, PA 6.12, PA 7.7, PA 8.8, PA 9.9, PA 10.9, PA 12.12, PA 6/6.6, PA 6.6/6, PA 6T and PA 61. PA 6 is particularly preferred. A detailed description of polyamides and copolyamides is to be found in Kunststoff-Handbuch Volume VI, Polyamide, Carl Hanser Verlag Munich, 1966; and Melvin I. Kohan, *Nylon Plastics Handbook*, Carl Hanser Verlag Munich, 1995, the content of which is incorporated in its entirety by reference.

Certain PAs or CoPAs can also be used for oil or fat barrier and are known to the person skilled in the art.

The multi-layer plastics film used according to the invention can preferably also comprise one or more adhesion promoter layers (b). Suitable adhesion-promoting polymers are known to the person skilled in the art.

The adhesion promoter layers (b) are preferably based, identically or differently, on a mixture of preferably modified polyolefins and/or olefin copolymers, preferably selected from the group comprising PE, PP modified by carboxyl groups and/or cyclic anhydride groups, in particular polyethylenes, polypropylenes and ethylene-vinyl acetate copolymers modified by maleic anhydride groups. Preference is given to maleic-anhydride-modified PE, PE modified by COOH groups, acid-modified copolymers of ethylene/vinyl acetate, acid-modified ethylene/(meth)acrylate copolymers or anhydride-modified ethylene (meth)acrylate copolymers, anhydride-modified ethylene-vinyl acetate copolymers or a polymer blend comprising at least two of the above-mentioned polymers. Polymers or copolymers modified by maleic anhydride are particularly preferred.

The multi-layer plastics film used as the insert can have up to 9, 10 or 11 layers, wherein the two outer, sealable layers are preferably based on PE. Most particular preference is given to a plastics film as insert that consists of ten layers and has the layer structure PE/PA/EVOH/PA/PE/PE/PA/EVOH/PA/PE.

In particular cases, the multi-layer plastics film used as the insert can also comprise a paper layer as an outer layer, wherein the bond between the multi-layer plastics film and the paper layer is provided via a laminating layer. Laminating layers and the materials suitable therefor are known to the person skilled in the art. The otherwise preferably transparent plastics film preferably has a paper layer which faces the packaged product as an insert and preferably has a grammage of from 20 g/m$^2$ to 100 g/m$^2$.

There is particularly preferred as the insert a multi-layer plastics film which is heat-sealable, highly transparent and suitable for foodstuffs, which has at most a shrinkage of <5% and additionally has a barrier against gases, such as oxygen and/or water vapor, against moisture, against the migration of low molecular weight components and/or against taste or odor impairment and/or against fats and oils.

The insert according to the invention of the described plastics films is not divided into chambers by intermediate walls of, for example, connected protrusions or spikes consisting of the plastics film of the insert. The insert preferably consists of a compact plastics film without openings, such as perforations.

After the packaging tray according to the invention has been filled with packaged product, it is closed with a packaging element for closing the tray (the closing element), preferably with a lid. The closing element, preferably the lid, of the packaging system according to the invention is preferably based on a heat-sealable, single- or multi-layer plastics film. If the closing element, preferably the lid, is composed of a multi-layer plastics film, it can also have a pressure-sensitive adhesive layer, at least in the region of the seal seam, as a reclosable device.

In a preferred embodiment, the plastics film used as the closing element is multi-layer, wherein at least one layer is based on a polyester, copolyester or mixtures thereof. The multi-layer plastics film of this element preferably comprises the layers:

(g) a sealing layer, preferably a heat-sealable layer, (g) which faces the packaged product and is composed of at least one thermoplastic olefin homo- or co-polymer, cyclo-olefin copolymer or mixtures thereof,
(b) optionally an adhesion promoter layer (b),
(c) optionally a layer (c) composed of at least one homo- and/or co-polyamide,
(d) optionally at least one internally arranged barrier layer (d),
(c) optionally a further layer (c) composed of at least one homo- and/or co-polyamide,
(b) optionally a further adhesion promoter layer (b), and
(h) a layer (h) composed of a polyester, copolyester or a mixture thereof, preferably as the outer layer.

According to the invention, the plastics film which is used as the closing element is preferably orientated in the longitudinal and/or transverse direction in a orientation ratio of at least 1:1.5, preferably at least 1:2, particularly preferably from 1:2 to 1:4, as a result of which the multi-layer plastics film has a particularly high puncture resistance.

The plastics film used as the lid element preferably has a thickness of from 20 to 350 μm, more preferably from 30 to 300 μm, yet more preferably from 35 to 250 μm, most preferably from 40 to 200 μm and in particular from 45 to 150 μm or from 50 to 120 μm.

Particularly preferably, the multi-layer plastics film used as the closing element, which is sealable, highly transparent and optionally reclosable and is suitable for foodstuffs, exhibits virtually no back-shrinkage and preferably exhibits a barrier against gases, such as oxygen or water vapor, against moisture, against the migration of low molecular weight components, against taste and odor impairment and/or against fats and oils.

The plastics film used as the closing element preferably has an oxygen permeability according to DIN 53380-3 of less than 10.00 cm$^3$/(m$^2$·d·bar) at 23° C. and 50% relative humidity. Preferably, the oxygen permeability is not more than 8 cm$^3$/(m$^2$·d·bar), preferably not more than 7 or 6 cm$^3$/(m$^2$·d·bar), more preferably not more than 5, 4 or 3 cm$^3$/(m$^2$·d·bar), yet more preferably not more than 2, 1 or 0.5 cm$^3$/(m$^2$·d·bar), most preferably not more than 0.4, 0.3 or 0.2 $cm^3/(m^2 \cdot d \cdot bar)$ and in particular not more than 0.1, 0.09 or 0.08 $cm^3/(m^2 \cdot d \cdot bar)$ (in each case at 23° C. and 50% relative humidity).

In addition, the multi-layer plastics film used as the closing element preferably has at most a water vapor permeability which corresponds to the above-mentioned values of the oxygen permeability, wherein the water vapor permeability is determined according to DIN ISO 53 122.

In addition to the packaging tray according to the invention comprising the corrugated board structure and the before-described insert, the packaging system according to the invention preferably also has, for closing the packaging tray, a preferably transparent closing element, preferably a lid, of a preferably multi-layer, optionally reclosable plastics film optionally having the mentioned barrier properties. Suitable barrier layers have already been disclosed above in connection with the description of the multi-layer plastics film used as the insert according to the invention.

Particularly preferably, the closing element is made of an at least two-layer plastics film. The material of this plastics film and the multi-layer plastics film used as the insert can be the same or different. Preferably for the lid any desired plastics film known to the person skilled in the art, in particular from the field of foodstuffs technology, can be used, which film preferably has a polyester layer. The plastics film of the closing element can optionally be printed.

Particularly preferably, the plastics film of the closing element comprises a heat-sealable layer (g), which is preferably based on the same polymer as the heat-sealable layers (a) or (e) of the plastics film from which the insert is built, or at least on the same type of polymer. Suitable polymers for producing the layers (b), (c), (d) and (f) that are optionally present in the plastics film of the closing element have already been disclosed in connection with the description of the plastics film used as the insert.

The layer (h), which is preferably present, of the plastics film of the lid, is based on at least one polyester or at least one copolyester which is preferably selected from the group comprising polyethylene terephthalates (PET), in particular c-PET, a-PET, CoPET, PBT and CoPBT. The polyester or copolyester layer can optionally also be orientated. "PET" denotes polyethylene terephthalates which have been prepared from ethylene glycol and terephthalic acid. Amorphous PET (a-PET) and crystalline PET (c-PET) can also be used. "CoPET" denotes copolyesters which comprise, in addition to ethylene glycol and terephthalic acid, also further monomers, such as, for example, branched or aromatic diols. "CoPBT" denotes polybutylene terephthalates. Preferably, the polyester or copolyester that is used has an intrinsic viscosity of preferably from 0.1 to 2.0 dl/g, more preferably from 0.3 to 1.5 dl/g, in particular from 0.6 to 1.0 dl/g, wherein the method for determining the intrinsic viscosity is known to the person skilled in the art. A detailed description of suitable PET, PBT, polycarbonates (PC) and copolycarbonates (CoPC) is disclosed in Kunststoffhandbuch Volume 3/1—technische Thermoplaste: Polycarbonate, Polyacetale, Polyester, Celluloseester; Carl Hanser Verlag, 1992, the content of which is incorporated in its entirety by reference.

Most particularly preferably, the plastics film used as closing element comprises a preferably at least two-layer plastics film which has a layer based on PE or orientated PET (oPET), wherein the heat-sealable layer of PE, as the closing element, faces the packaged product. The plastics film of the closing element, preferably of the lid, is optionally reclosable by means of a pressure-sensitive adhesive layer.

The plastics film of the closing element can also comprise a paper layer, wherein the bond between the preferably multi-layer plastics film and the paper layer is provided by a laminating layer. Suitable materials for laminating layers are known to the person skilled in the art. This paper layer of the closing element can have a cutout in the form of a window for inspection. The closing element, preferably the lid, of the packaging system according to the invention can consist of a composite of a preferably multi-layer plastics film and a paper web, wherein the paper web optionally has a cutout in the form of a window.

The layers of the preferably multi-layer plastics films used as the insert and of the preferably multi-layer plastics film used as the closing element can optionally contain additives selected from the group comprising antioxidants, antiblocking agents, antifogging agents, antistatics, antimicrobial active ingredients, light stabilizers, UV absorbers, UV filters, dyes, coloring pigments, stabilizing agents, preferably heat stabilizers, process stabilizers and UV and/or light stabilizers, preferably based on at least one sterically hindered amine (HALS), peel additives or processing aids.

In order to produce the packaging tray according to the invention, the described plastics film in the form of a plastics film web is deep drawn into the already existing corrugated board structure, preferably under the supply of heat and application of a vacuum or of pressure, until the plastics film has a substantially identical shape to the structure on the inner side of the side walls thereof down to the bottom and forms a loose contact surface on the inner side of the corrugated board structure and does not shrink back, wherein at the same time gas is evacuated between the plastics film insert and the corrugated board structure by means of at least one gas venting opening, or gas venting openings, situated at least in the bottom region of the cardboard structure. Alternatively, the plastics film web can also be brought at least partially into the shape of the insert before it is deep drawn into the corrugated board structure for final shaping.

The method for producing the packaging according to the invention is preferably carried out in such a manner that, in order to produce the packaging tray according to the invention, the plastics film web serving as the insert is first deep drawn, preferably with heating, under vacuum and/or with the application of pressure, into the folded or mechanically shaped corrugated board structure until the plastics film has a substantially identical shape to the tray of corrugated board and forms a loose contact surface on the inner side of the side walls down to and over the bottom of the corrugated board structure and does not shrink back, wherein at the same time gas is evacuated between the insert and the corrugated board structure by means of the gas venting opening, or gas venting openings, situated at least in the bottom region of the cardboard structure of corrugated board, the corrugated board structure is connected with the insert along the periphery by material bonding, preferably by means of heat sealing or pressing, at the upper portion, preferably as far as the upper edge of the inner side of each side wall, and, after filling, the packaging tray, optionally after gas exchange, is closed with the closing element, preferably a lid, of one of the mentioned plastics films by sealing with the portion of the insert of plastics film that projects along the periphery beyond the entire edge of the corrugated board structure.

The material-based connection of the insert to the corrugated board structure is not performed with flaps.

In order to be able to remove without difficulty the superfluous air during deep drawing of the insert into the corrugated board structure, the corrugated board structure has in the bottom region at least one gas venting opening, preferably a plurality of gas venting openings arranged at regular intervals.

The number of gas venting openings is preferably governed by the size of the corrugated board structure.

The gas venting openings can have any shape. Preferably, the gas venting openings are in the form of slots which preferably have a length of from 0.5 cm to 10 cm, more preferably from 1 cm to 5 cm.

The gas venting openings of the corrugated board structure are preferably arranged in the edges between each side wall and the bottom region or in the bottom.

In a particularly preferred embodiment, the gas venting openings of the corrugated board structure, preferably in the form of slots, are arranged at regular intervals in the edges between the bottom and the side walls, preferably complementary to the gas removal devices, that is to say air removal devices, of the particular shaping tool.

In order to bond the insert to the corrugated board structure in the indicated region, the preferably sealable plastics film can be connected by sealing, under heating and pressure, by crimping, by pressing or by adhesive bonding, for example by adhesive bonding with a self-adhesive film portion, in particular a double-sided self-adhesive film portion. Heat sealing with sealing tools is preferred. The material-based connection between the corrugated board structure and the insert is made by pressing the insert and the corrugated board structure together in the intended region under heating.

Accordingly, the insert of the packaging system according to the invention is preferably based on a plastics film which is thermoformed, preferably by deep drawing, and is connected to the corrugated board structure by a material-based connection by heat sealing or pressing in the mentioned regions, preferably over the whole periphery. This production process is described in WO 2011/134590 or WO 2011/134591.

The insert preferably has a peripheral edge in the form of a flange which projects over the entire peripheral edge of the corrugated board structure and is used for closing the packaging tray. This sealing edge preferably protrudes perpendicularly from the upper edge of the side walls.

After the packaging tray has been filled, it can be closed, after gas exchange, with the closing element, preferably the lid, based on one of the mentioned plastics films, by sealing with the flange.

LIST OF REFERENCE NUMERALS

1 corrugated board structure
2 gas venting opening
3 tool
4 gas removal devices of the tool
5 film web for producing the insert
6 insert
7 material-based connection between insert and corrugated board structure
8 film web for producing the lid FIG. 1 shows by way of example a diagram of the process for producing the packaging system according to the invention. The corrugated board structure (1) is introduced in turned-up form into the tool (3), wherein the tool (3) has the exact outer contours of the corrugated board structure (1) and is able to receive the corrugated board structure (1) completely (1A). The corrugated board structure (1) is provided with gas venting openings (2) (preferably slots) at the four edges, between the bottom and the side walls. The gas venting openings (2) are complementary to the gas removal devices of the tool (4). The film web (5) for producing the insert is positioned above the corrugated board structure (1) set into the tool (3) (1B). By means of pressure from above and vacuum from below, the film web (5) is drawn into the corrugated board structure (1) (not shown), as a result of which the insert (6) is obtained. The superfluous air is thereby removed via the gas venting openings (2) in the corrugated board structure (1) and the corresponding gas removal devices of the tool (4) (1C). The insert (6) resting on the side walls of the corrugated board structure (1) is connected to the cardboard structure by material bonding in the upper region of the inner side of the side walls (not shown). This material-based connection between the insert and the corrugated board structure (7) is preferably effected by heat sealing with a heat-sealing tool. After the packaging tray consisting of the corrugated board structure (1) and the insert (6) has been filled (not shown), the film web for producing the lid (8) is positioned above the packaging tray (1D). The packaging tray is then closed, preferably with gas exchange, by heat sealing the film web (8) onto the flange of the insert (6), protruding over the peripheral edge of the insert (6), whereby the packaging system according to the invention is obtained.

In a particularly preferred embodiment

- the corrugated board structure has a plurality of slot-like gas venting openings in the bottom surface or in the edges between the bottom surface and the side walls; and/or
- the corrugated board structure consists of a single-flute corrugated board, wherein the fluted web has a G, F or E profile; and/or
- the corrugated board structure consists of corrugated board paper webs of which preferably each have weight of from 50 to 150 g/m$^2$; and/or
- the insert is introduced into the corrugated board structure by deep drawing; and/or
- the insert and the inner side of the side walls of the corrugated board structure are each connected at an upper portion by sealing; and/or
- the insert is made of a plastics film having a layer structure (a), (b), (c), (d), (c), (b), optionally (f), optionally (f), optionally (b), optionally (c), optionally (d), optionally (c), optionally (b) and (e); and/or
- the insert has a thickness of from 90 to 220 μm; and/or
- the plastics film of the insert comprises layers of PE, PA and EVOH; and/or
- the closing element, preferably the lid, is built of an at least two-layer plastics film; and/or
- the plastics film of the closing element, preferably the lid, has a thickness of from 45 to 150 μm; and/or
- the plastics film of the closing element, preferably the lid, comprises layers of OPET or PE; and/or
- the insert is connected to the closing element by heat sealing; and/or
- the plastics film of the closing element has a reclosable arrangement based on a pressure-sensitive adhesive layer; and/or
- the packaging system according to the invention is a packaging for foodstuffs.

The packaging system according to the invention is suitable as a packaging for products of any kind, preferably foodstuffs, semi-luxury foods, animal feed and medical products, in solid or liquid form. Particularly preferably, the packaging system according to the invention is suitable as a packaging for raw or cooked foodstuffs such as meat and fish, meat products such as ham or sausages, ready meals, frozen foods, animal feed, dried powders of any kind, solid milk products, confectionery such as chocolate products, pasta, medical products and decorative articles.

The individual constituents or materials, coatings, colors, etc. of the packaging system according to the invention are in each case so chosen that they comply with the requirements for the packaging of the packaged product (e.g. suitability for foodstuffs in the case of foodstuffs and semi-luxury foods).

The packaging system according to the invention is preferably sterilizable, pasteurizable and/or suitable for microwaves.

The invention claimed is:

1. A packaging system comprising a packaging tray and a closing element, separate therefrom, for closing the packaging tray, wherein:

the packaging tray comprises a cardboard structure of corrugated board and an insert comprising a single- or multi-layer thermoformed plastics film;

the cardboard structure of corrugated board comprises a folded and fixed corrugated board blank fixed by adhesive bonding of a flap or a corrugated board that has been shaped mechanically by exposure to at least one of moisture and heat;

the cardboard structure of corrugated board comprises a side wall comprising an inner side comprising an upper portion and a lower portion, a bottom, a bottom portion, a periphery, and an edge;

the inner side is connected to the insert by a heat-sealed or pressed bond along the entirety of the periphery only in the upper portion;

the insert forms a loose contact surface with the lower portion down to the bottom;

the bottom portion comprises at least one gas venting opening; and the packaging tray is capable of being closed with the closing element by sealing with a portion of the insert that projects beyond the edge of the corrugated board structure along the periphery.

2. The packaging system as claimed in claim 1, wherein the cardboard structure of corrugated board consists of paper webs having a grammage of from 50 to 150 g/m$^2$.

3. The packaging system as claimed in claim 1, wherein the cardboard structure of corrugated board has at least one fluted web.

4. The packaging system as claimed in claim 1, wherein the cardboard structure of corrugated board comprises a plurality of fluted webs, wherein each fluted web can have the same or a different structure.

5. The packaging system as claimed in claim 1, wherein the at least one gas venting opening comprises a plurality of gas venting openings forming slots arranged at regular intervals in an edge between the bottom and the side wall.

6. The packaging system as claimed in claim 1, wherein the cardboard structure of corrugated board is printed.

7. The packaging system as claimed in claim 1, wherein the insert comprises a thermoformed, multi-layer plastics film comprising a transparent film composite consisting of:

an optionally multi-ply heat-sealable layer based on at least one thermoplastic polymer;

at least one transparent layer of a thermoplastic polymer having a specific functionality; and at least two adhesion promoter layers comprising a thermoplastic polymer.

8. The packaging system as claimed in claim 7, wherein:

the at least one transparent layer is a barrier layer against at least one of a gas, moisture, the migration of low-molecular weight components, taste impairment, or odor impairment; and the barrier layer is bonded to an adjacent layer by way of an adhesion promoter layer.

9. The packaging system as claimed in claim 7, wherein the transparent film composite comprising a paper layer facing the interior of the packaging system.

10. The packaging system as claimed in claim 1, wherein the insert consists of a multi-layer plastics film.

11. The packaging system as claimed in claim 1, comprising a packaging tray of corrugated board structure with an insert of plastics film and a separate closing element.

12. The packaging system as claimed in claim 11, wherein:

the closing element comprises a composite comprising an optionally multi-layer plastics film and a paper web; and the paper web optionally comprises a cutout in the form of a window.

13. The packaging system as claimed in claim 12, wherein the multi-layer plastics film comprises a pressure-sensitive adhesive layer as a reclosable device.

14. The packaging system as claimed in claim 1, wherein the packaging system is suitable as a packaging for a foodstuff, a semi-luxury food, an animal feed, a medical product in solid or liquid form.

15. The packaging system as claimed in claim 14, wherein the packaging is sterilizable, pasteurizable, and/or suitable for microwaves.

16. A method for producing the packaging system as claimed in claim 1, comprising:

deep-drawing, under heating, under vacuum and/or with application of pressure, the single- or multi-layer thermoformed plastics film into a ready-folded or mechanically-shaped cardboard structure of corrugated board until the single- or multi-layer thermoformed plastics film is of substantially identical shape as the ready-folded or mechanically-shaped cardboard structure and forms a loose contact surface on the inner side wall and over the bottom and does not shrink back;

evacuating, at the same time as the deep-drawing, gas from between the insert and the ready-folded or mechanically-shaped cardboard structure of corrugated board structure by the at least one gas venting opening;

bonding the insert to the corrugated board structure by material bonding by heat-sealing or pressing in the upper portion not higher than an upper edge of the inner side of the side wall along the periphery with the insert.

17. The packaging system as claimed in claim 1, wherein the adhesive bonding is by way of a dispersion adhesive.

* * * * *